US010150125B2

(12) United States Patent
Bruder et al.

(10) Patent No.: US 10,150,125 B2
(45) Date of Patent: Dec. 11, 2018

(54) DISCHARGE HEAD FOR A METERING DISPENSER AND A METERING DISPENSER

(71) Applicants: Thomas Bruder, Constance (DE); Tobias Baumann, Gottmadingen-Randegg (DE)

(72) Inventors: Thomas Bruder, Constance (DE); Tobias Baumann, Gottmadingen-Randegg (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 13 days.

(21) Appl. No.: 15/502,582

(22) PCT Filed: Jul. 20, 2015

(86) PCT No.: PCT/EP2015/066510
§ 371 (c)(1),
(2) Date: Feb. 8, 2017

(87) PCT Pub. No.: WO2016/026633
PCT Pub. Date: Feb. 25, 2016

(65) Prior Publication Data

US 2017/0225182 A1 Aug. 10, 2017

(30) Foreign Application Priority Data

Aug. 22, 2014 (DE) ..... 10 2014 216 744

(51) Int. Cl.
*B05B 11/00* (2006.01)

(52) U.S. Cl.
CPC ..... *B05B 11/0081* (2013.01); *B05B 11/0062* (2013.01); *B05B 11/3015* (2013.01); *B05B 11/3069* (2013.01); *B05B 11/3084* (2013.01)

(58) Field of Classification Search
CPC ..... B05B 11/0081; B05B 11/0662; B05B 11/3015; B05B 11/3069; B05B 11/3084
(Continued)

(56) References Cited

U.S. PATENT DOCUMENTS 5,385,270 A * 1/1995 Cataneo ..... B05B 11/3081 222/134
5,848,732 A * 12/1998 Brugger ..... B05B 11/3083 222/137
(Continued)

FOREIGN PATENT DOCUMENTS

CN 101418903 A 4/2009
CN 101815583 A 8/2010
(Continued)

OTHER PUBLICATIONS

International Search Report issued in Application No. PCT/EP2015/066510 with English translation dated Sep. 25, 2015 (4 pages).
(Continued)

*Primary Examiner* — Lien Ngo
(74) *Attorney, Agent, or Firm* — Flynn Thiel, P.C.

(57) ABSTRACT

A metering dispenser for simultaneously or selectively discharging two media, including an outlet opening, a first reservoir for a first medium, a first metering-conveyor device for conveying the first medium from the first reservoir, a second reservoir for a second medium, a second metering-conveyor device for conveying the second medium from the second reservoir, a mixing chamber arranged upstream of the outlet opening and in which the first medium, conveyed by the first metering-conveyor device, and/or second medium, conveyed by the second metering-conveyor device, is stored temporarily, and an output-conveyor device for conveying the medium or media from the mixing chamber to the outlet opening. The first metering-conveyor device has the form of a metering-pump
(Continued)

device with a variable-volume metering chamber, an inlet fluidically connected to the first reservoir and having an inlet valve, and an outlet fluidically connected to the mixing chamber and having an outlet valve.

18 Claims, 2 Drawing Sheets

(58) Field of Classification Search
USPC ..... 222/145.5–145.8, 144, 137, 94, 134
See application file for complete search history.

(56) References Cited

U.S. PATENT DOCUMENTS 6,464,107 B1 * 10/2002 Brugger ..... B05B 11/3056 222/134
2003/0146242 A1 * 8/2003 Peterson ..... B05B 11/0078 222/137
2005/0042122 A1 * 2/2005 Arghyris ..... B05B 11/0072 417/521
2010/0193547 A1 8/2010 Laidler et al.

FOREIGN PATENT DOCUMENTS

DE 198 18 434 A1 10/1999
DE 10 2004 015 815 A1 11/2005
DE 10 2006 033 253 A1 1/2008

OTHER PUBLICATIONS

Written Opinion of International Searching Authority issued in Application No. PCT/EP2015/066510 dated Sep. 25, 2015 (5 pages).
First Chinese Office Action issued in Appln. No. 201580045119.3 dated Aug. 24, 2018 with English translation (12 pages).

* cited by examiner

DISCHARGE HEAD FOR A METERING DISPENSER AND A METERING DISPENSER

FIELD OF APPLICATION AND PRIOR ART

The invention relates to a metering dispenser for the simultaneous or selective discharge of two fluid, gel-like or paste-like media.

Metering dispensers for the simultaneous or selective discharge of two fluid, gel-like or paste-like media are known, for example, from DE 10 2006 033 253 A1. The metering dispensers known from DE 10 2006 033 253 A1 have two chambers for storing media, two conveying devices for conveying the media from the chambers and a mixer for mixing the media, wherein the conveying devices each have a spindle and a piston which can be adjusted by means of the spindle and which reduce a volume of the chamber. According to an embodiment which is known from DE 10 2006 033 253 A1, the mixer comprises a cylinder in which the media accumulate, and a piston by means of which the media are displaced out of the cylinder into an applicator.

PROBLEM AND SOLUTION

An object of the invention is to provide a metering dispenser for the simultaneous or selective discharge of two fluid, gel-like or paste-like media and a discharge head for a metering dispenser which can be operated in a simple manner and which enable precise metering of the media.

This object is achieved by the metering dispenser and the discharge head having the features of claims 1 and 15.

According to a first aspect, there is provided a metering dispenser for the simultaneous or selective discharge of two fluid, gel-like or paste-like media comprising an outlet opening, a first storage chamber for storing a first medium, a first metering/conveying device for conveying the first medium from the first storage chamber, a second storage chamber for storing a second medium, a second metering/conveying device for conveying the second medium from the second storage chamber, a mixing chamber which is arranged upstream of the outlet opening, wherein the first medium which is conveyed by means of the first metering/conveying device and/or the second medium which is conveyed by means of the second metering/conveying device can be temporarily stored in the mixing chamber, and a discharge/conveying device for conveying the medium or the media from the mixing chamber to the outlet opening, wherein at least the first metering/conveying device is constructed as a metering/pump device comprising a metering chamber having a variable volume, an inlet which is connected in fluid terms to the first storage chamber and which has an inlet valve and an outlet which is connected in fluid terms to the mixing chamber and which has an outlet valve.

A metering/pump device enables simple and precise metering of a medium which is conveyed from the storage chamber into the mixing chamber, wherein it is possible to convey both semi-solid viscous media, such as, for example, a skin cream, and thin or thick media such as, for example, a lotion. Metering/pump devices can additionally be constructed to be small. Mixing is carried out in this instance only in the mixing chamber. In the metering chambers and the storage chambers, the products are reliably separated from each other.

Preferably, the metering dispenser is constructed in such a manner that two media are mixed. However, other embodiments are also conceivable in which three or four media are mixed.

The metering chamber of the first metering/conveying device which is constructed as a metering/pump device is arranged between the storage chamber and the mixing chamber. Preferably, both metering/conveying devices, or in the case of more than two metering/conveying devices, all the metering/conveying devices are constructed as a metering/pump device, wherein the respective metering chamber is arranged between the associated storage chamber and the mixing chamber. With a reduction in the volume, a medium which is present in the metering chamber is displaced and conveyed via the outlet in the direction of the mixing chamber. A quantity of the medium which is conveyed into the mixing chamber can consequently be determined by a reduction of the volume which is also referred to as a metering stroke.

In advantageous embodiments, the metering dispenser has a discharge head which can be connected to the first storage chamber and the second storage chamber, wherein the discharge head comprises at least the outlet opening, the first metering/conveying device which is constructed as a metering/pump device and the discharge/conveying device. Preferably, the discharge head comprises all the metering/pump devices of the metering dispenser. The discharge head can be provided as an operational pre-assembled subassembly on a filler. The storage chambers are in one embodiment releasably connected to the discharge head in a tool-free and non-destructive manner, wherein a storage chamber can be replaced by a user, if necessary. In other embodiments, there is no provision for a storage chamber to be replaced by a user.

The discharge head comprises in an advantageous embodiment a housing which at least partially delimits the mixing chamber, the metering chamber of the metering/pump device and/or a first supply channel which is provided between the mixing chamber and the metering chamber. As a result of such a housing, the number of components of the discharge head and consequently of the metering dispenser is minimized.

In an advantageous development, the housing comprises a base plate and at least one peripheral wall which protrudes from the base plate and which at least partially delimits the mixing chamber or the metering chamber. Preferably, the housing has three peripheral walls which protrude from the base plate and which at least partially delimit the mixing chamber and the two metering chambers of the two metering/pump devices. The positioning of the three walls is in this instance preferably selected in such a manner that the two metering chambers can each be connected to the mixing chamber by means of a linear supply channel.

In an embodiment, the metering chamber has a resilient deformable wall. The wall can be deformed in one embodiment with application of an external force with the volume of the metering chamber being reduced in order to displace the medium. When the external force is discontinued, the wall is moved back into the starting position as a result of internal restoring forces and/or by means of additional restoring springs, wherein a medium is conveyed from the storage chamber into the metering chamber as a result of a reduced pressure which occurs in the metering chamber.

In advantageous embodiments, the metering/pump device has a piston which is adjustably supported in the metering chamber. By means of an appropriately constructed piston, an at least almost complete emptying of the metering chamber is possible in a metering stroke. This is advantageous in particular with sensitive cosmetic media. The piston is in one embodiment adjustably supported in the radial direction of the metering dispenser. In advantageous embodiments, a piston which is adjustably supported in the axial direction of the metering dispenser is provided.

For an adjusting movement of the piston, in one embodiment an automatic or semi-automatic actuation device is provided. In advantageous embodiments, the metering/pump device has for manual actuation an actuation handle by means of which the piston can be adjusted counter to the force of a restoring spring in order to reduce the volume of the metering chamber. The actuation handle is provided in accordance with an embodiment of the metering dispenser and an arrangement of the piston on a suitable surface of the metering dispenser.

In an embodiment, an inlet and/or an outlet of the metering/pump device are provided on a side wall of the metering chamber. In advantageous embodiments, the inlet and the outlet of the metering/pump device are provided at an end of the metering chamber opposite the piston.

The inlet valve and the outlet valve can be constructed by the person skilled in the art in an appropriate manner. In advantageous embodiments, both valves are constructed as non-return valves.

For a space-saving arrangement, in an embodiment the outlet has a channel piece which protrudes into the metering chamber, wherein the inlet is provided on an annular channel which surrounds the channel piece.

In advantageous embodiments, a valve element which has the inlet valve and the outlet valve is provided in order to reduce the components in the assembly.

By means of the discharge/conveying device the medium present in the mixing chamber or media present in the mixing chamber can be conveyed from the mixing chamber to the outlet opening. In advantageous embodiments, the mixing chamber has to this end a variable volume, wherein the volume can be increased in a passive manner by means of incoming medium or incoming media and can be reduced by means of the discharge/conveying device in order to discharge the medium or the media. In this instance, in one embodiment there is provision for the mixing chamber to have a resiliently deformable wall, wherein the wall is preferably constructed in such a manner that a volume change is brought about only in the case of active forces applied by a user or by incoming medium.

In advantageous embodiments, the discharge conveying device has a piston which can be displaced in the mixing chamber and an outlet channel which is connected in fluid terms to the outlet opening. The piston can preferably be displaced in an axial direction. A displacement of the piston in the direction of an upper rest position is brought about in advantageous embodiments by means of incoming medium. For discharge, the piston can be displaced in the direction of the lower rest position by means of forces which are applied.

For a displacement of the piston, the discharge/conveying device has in advantageous embodiments an actuation handle by means of which the piston can be adjusted in order to reduce the volume of the mixing chamber and consequently to discharge medium or media from the mixing chamber.

The outlet opening is in advantageous embodiments provided on the actuation handle, wherein the outlet channel extends through the piston.

For good mixing of the media, in advantageous embodiments a static mixing system for redirecting the flow is provided in the outlet channel. The mixing system has in advantageous embodiments a mandrel which protrudes into the outlet channel, wherein a helical path is provided on a wall of the outlet channel and/or a wall of the mandrel.

The object is further achieved by means of a discharge head for a metering dispenser having a first storage chamber for storing a first medium and a second storage chamber for storing a second medium, comprising an outlet opening, a first metering/pump device for conveying the first medium from the first storage chamber, which has a metering chamber having a variable volume, an inlet having an inlet valve and an outlet having an outlet valve, a second metering/pump device for conveying the second medium from the second storage chamber which has a metering chamber having a variable volume, an inlet having an inlet valve and an outlet having an outlet valve, a mixing chamber which is arranged upstream of the outlet opening and in which the first medium which is conveyed by means of the first metering/pump device and/or the second medium which is conveyed by means of the second metering/pump device can be temporarily stored, and a discharge/ conveying device for conveying the medium or the media from the mixing chamber to the outlet opening.

BRIEF DESCRIPTION OF THE DRAWINGS

Other advantages and aspects of the invention will be appreciated from the claims and from the following description of a preferred embodiment of the invention which is explained below with reference to the Figures. In the schematic drawings:

DETAILED DESCRIPTION OF THE EMBODIMENTS

Figure 1:
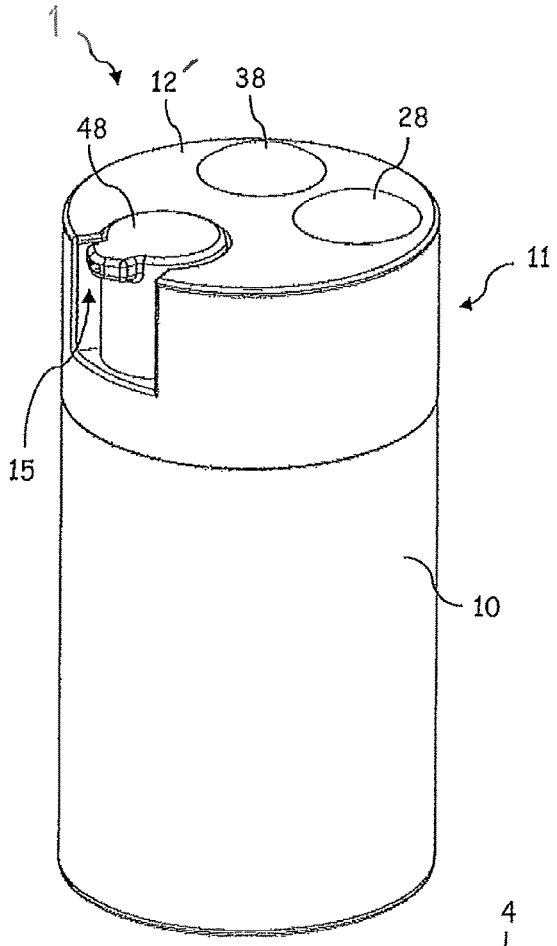
FIG. 1 is a perspective illustration of a metering dispenser.
Figure 2:
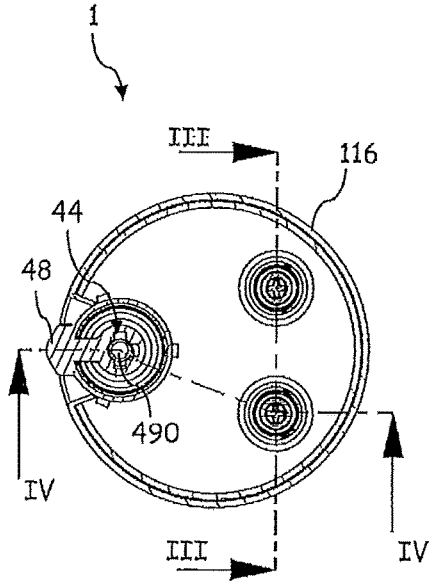
FIG. 2 is a plan view of the metering dispenser according to FIG. 1.

FIGS. 1 to 5 are various views of a metering dispenser 1 for the simultaneous or selective discharge of two fluid, gel-like or paste-like media.

The metering dispenser 1 illustrated comprises a housing 10, a discharge head 11, a first storage chamber 12 for storing a first medium and a second storage chamber 13 for storing a second medium. In the embodiment illustrated, the storage chambers 12, 13 are provided in the housing 10, which to this end has the partition wall 14 which can be seen in the sectioned views according to FIGS. 3 and 4. For a discharge of the media, the metering dispenser 1 has an outlet opening 15.

The metering dispenser 1, more precisely the discharge head 11 thereof, comprises a first metering/conveying device which is constructed as a first metering/pump device 2 and a second metering/conveying device which is constructed as a second metering/pump device 3. The metering/pump devices 2, 3 each have a metering chamber 20, 30, a piston 21, 31 which is displaceably supported in the metering chamber 20, 30, a restoring spring 22, 32, an inlet 23, an outlet 24, 34 and an actuation handle 28, 38. The inlet 23 and the outlet 24, 34 are arranged on the metering chambers 20, 30 at an end opposite the associated actuation handles 28, 38.

Figure 5:
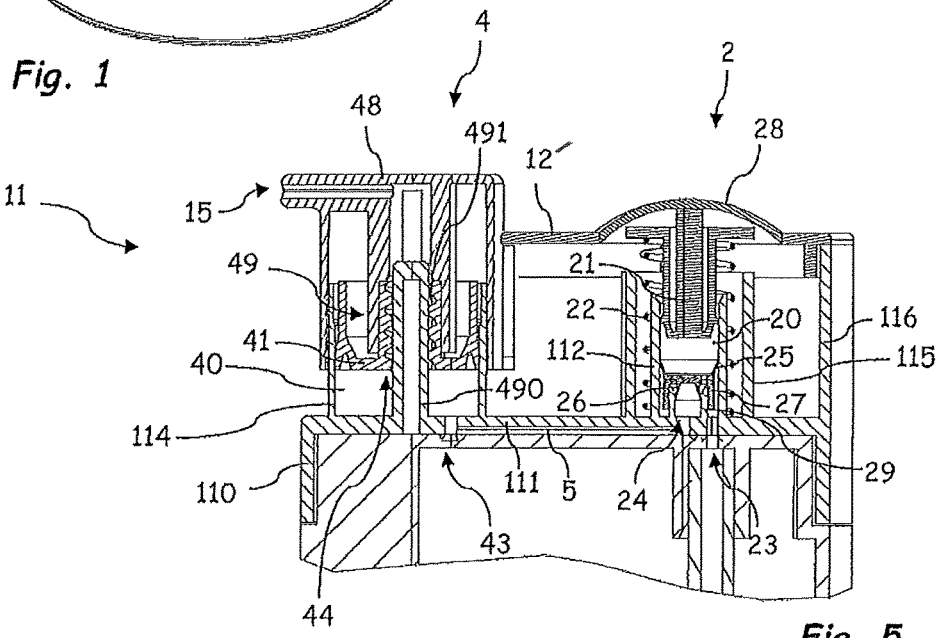
FIG. 5 shows a discharge head of the metering dispenser before a medium is discharged.
Figure 3:
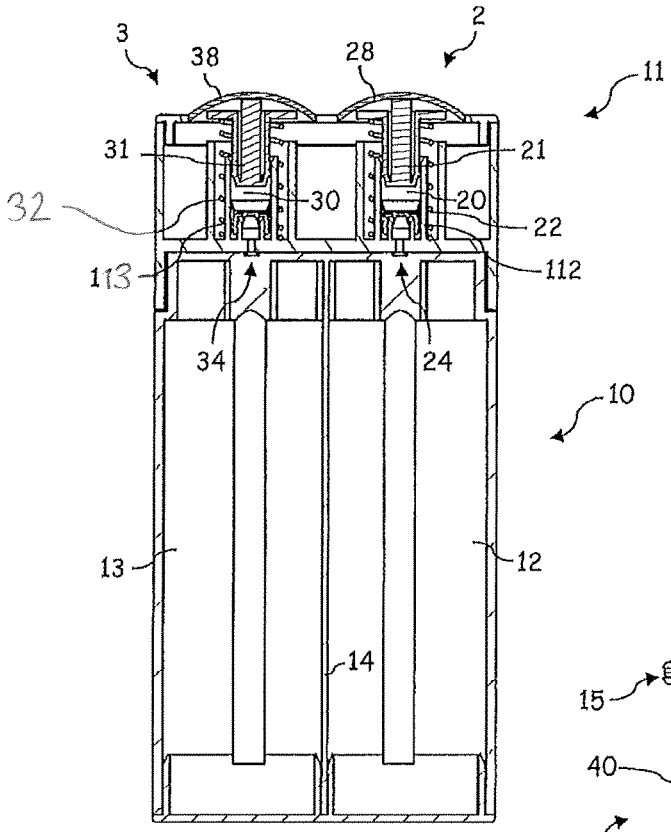
FIG. 3 is a sectioned view of the metering dispenser along a plane of section III-III according to FIG. 2.

As can best be seen in the detailed view according to FIG. 5, an inlet valve 25 is associated in each case with the inlet 23 and an outlet valve 26 is associated in each case with the outlet 24. In the embodiment illustrated, the inlet valve 25 and the outlet valve 26 are produced as a common component, which is supported by means of a sleeve-like bearing element 27 on a channel piece 29 which protrudes into the metering chambers 20, 30. The channel piece 29 delimits the outlet 24 which is located at the inner side of the channel piece 29. The associated inlet 23 is provided in an annular channel formed between a wall 112 of the metering chamber 20 and the channel piece 29.

Figure 4:
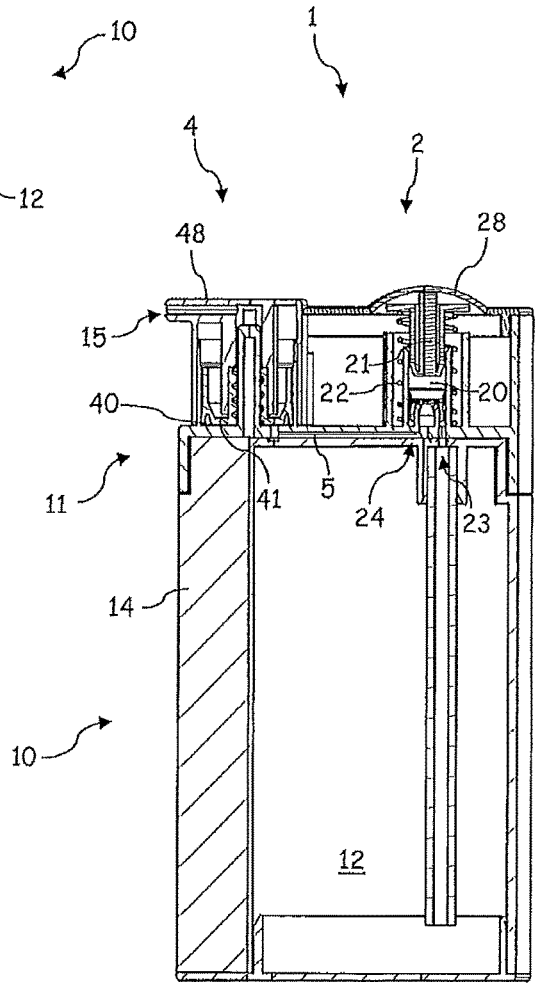
FIG. 4 is a sectioned view of the metering dispenser along a plane of section IV-IV according to FIG. 2.

The outlets 24, 34 are connected in fluid terms to a mixing chamber 40 by means of two supply channels 5, wherein in the views illustrated only one supply channel 5 can be seen. The mixing chamber 40 illustrated has a variable volume, wherein the volume can be increased in a passive manner by means of incoming medium or media, as illustrated schematically in FIGS. 4 and 5. FIG. 4 shows in this instance the metering dispenser 1 after a medium discharge or before initial operation. FIG. 5 shows the discharge head 11 of the metering dispenser 1 after a medium or a plurality of media have been conveyed into the mixing chamber 40 with the volume being increased.

The metering dispenser 1 further comprises a discharge/conveying device 4 having a piston 41 and an actuation handle 48 for conveying the medium or the media from the mixing chamber 40 to the outlet opening 15. The mixing chamber 40 has one or two inlet(s) 43 which is/are opposite the actuation handle 48 and into which the supply channels 5 open. A medium is conveyed with a displacement of the piston 41 from the mixing chamber 40 via an outlet channel 44 to the outlet opening 15. The outlet channel 44 comprises in the embodiment illustrated a first channel portion which extends in the actuation direction through the piston 41 and the actuation handle 48 and a second channel portion which extends radially relative to the actuation direction through the actuation handle 48, wherein the outlet opening 15 is provided at a free end of the second channel portion on the actuation handle 48. A corresponding arrangement has been found to be advantageous for dispensing viscous products onto a hand of a user. However, other embodiments are also conceivable.

The discharge/conveying device 4 illustrated further has a static mixing system 49 which is constructed as a helical spindle. The mixing system 49 illustrated comprises a mandrel 490 which is arranged in a fixed manner on the housing of the discharge head 11 and which protrudes into the outlet channel 44, wherein in the region of the piston 41 a helical path 491, for example, in the form of an inner thread, is incorporated in a covering face of the outlet channel 44. Alternatively, it is conceivable for the mandrel 490 to be constructed as a spindle-like journal. In yet other embodiments, no mixing system is provided.

In the embodiment illustrated, the discharge head 11 comprises a housing 110 which is produced, for example, as an injection-molded component and which has a base plate 111 and three peripheral walls 112, 113, 114, which protrude from the base plate 111. The three walls 112, 113, 114 delimit in a peripheral direction the metering chambers 20, 30 and the mixing chamber 40. The mandrel 490 of the mixing system 49 and the channel piece 29 are also formed by means of portions of the housing 110 protruding from the base plate 111. An assembly of the additional components of the metering/pump devices 2, 3 and/or the discharge conveying device 4 is possible in a simple manner via an open end of the walls 112, 113, 114 opposite the base plate 111. In the embodiment illustrated, there are further provided on the housing 111 peripheral walls 115 which surround the restoring springs 22, 32 and which protrude from the base plate 111 and are arranged concentrically relative to the walls 112, 113 of the metering chambers 20, 30. The housing 110 is closed by means of a cover 12', wherein the housing 110 has an annular web 116 for assembly of the cover 12'.

At a lower side of the base plate 111 opposite the walls 112, 113, 114 there are provided grooves which delimit the supply channels 5. The supply channels 5 are closed by the housing 10 of the storage containers 12, 13.

For a discharge, the first metering/pump device 2 and/or the second metering/pump device 3 are first actuated. To this end, a force is applied to the actuation handle 28, 38 of the respective metering/pump device 2, 3 and, by means of the actuation handle 28, 38, the piston 21, 31 is moved counter to the force of the restoring spring 22, 32 so that a volume of the metering chamber 20, 30 of the metering/pump device 2, 3 is reduced. In the metering chamber 20, 30 air which is present in the delivery state or a product which is located therein is displaced. The inlet valves 25 are constructed in such a manner that they remain closed in spite of the increasing pressure in the associated metering chamber 20, 30. The outlet valves 26 are in contrast constructed in such a manner that they open as a result of the increasing pressure in the associated metering chamber 20, 30 so that the air which is displaced as a result of the reduction of the volume or the displaced product is conveyed via the supply channel 5 into the mixing chamber 40. In this instance, as a result of the incoming product, the piston 41 is moved upwards out of the lower rest position illustrated in FIG. 4.

When the force which is applied to the actuation handle 28, 38 of the first metering/pump device 2 and/or the second metering/pump device 3 is discontinued, the piston 21, 31 of the first metering/pump device 2 and/or the second metering/pump device 3 as a result of the restoring force of the restoring spring 22, 32 is moved into the initial position illustrated in FIG. 4 again. The outlet valves 26 are configured in such a manner that they remain closed in spite of a suction action in the associated metering chamber 20, 30 in the event of a backward movement. The associated inlet valve 25 is in contrast opened as a result of the suction action so that the product is conveyed out of the storage chamber 12, 13 which is connected in fluid terms into the metering chamber 20, 30.

This operation can be repeated if necessary until a maximum filling volume of the mixing chamber 40 is reached and/or until a desired quantity of product has been conveyed.

A discharge of the media which are temporarily stored in the mixing chamber 40 is carried out by means of a subsequent actuation of the discharge/conveying device 4. By applying a force to the actuation handle 48 of the discharge/conveying device 4, the actuation handle 48 is moved with the piston 41 so that the product is conveyed from the pump chamber 40 to the outlet channel 44. In this instance, the outlet valves 26 of the metering/pump devices 2, 3 prevent the medium or the media from being conveyed back into the metering chambers 20, 30. If two media have been conveyed by means of the two metering/pump devices 2, 3 into the mixing chamber 40, they are mixed during discharge. In the metering/pump devices 2, 3 and in the storage chambers 12, 13 the media are in contrast reliably separated from each other.

The mixing chamber 40 of the discharge/conveying device 4 is at least almost completely emptied by the actuation. After the actuation, the actuation handle 48 of the discharge/conveying device 4 remains in the lower rest position illustrated in FIG. 4. Only in the event of repeated conveying of the medium or the media into the mixing chamber 40 by means of actuation of the metering/pump devices 2, 3 is the actuation handle 48 moved with the piston 41 with the volume of the mixing chamber 40 being increased.

For a movement of the pistons 21, 31 of the metering/pump devices 2, 3 counter to the force of the restoring springs 22, 32, in the embodiment illustrated two actuation handles 28, 38 which can be used separately from each other are provided. In other embodiments, a common actuation handle is provided for both metering/pump devices 2, 3. In one embodiment, a metering stroke which can be brought about by the common actuation handle can be adjusted differently for the two metering/pump devices 2, 3 by means of suitably constructed actuation means in this instance.

The invention claimed is:

1. A metering dispenser for the simultaneous or selective discharge of two fluid, gel-like or paste-like media comprising:

an outlet opening;

a first storage chamber for storing a first medium;

a first metering/conveying device for conveying the first medium from the first storage chamber;

a second storage chamber for storing a second medium;

a second metering/conveying device for conveying the second medium from the second storage chamber;

a mixing chamber which is arranged upstream of the outlet opening, wherein the first medium which is conveyed by the first metering/conveying device and/or the second medium which is conveyed by the second metering/conveying device can be temporarily stored in the mixing chamber; and a discharge/conveying device for conveying the medium or the media from the mixing chamber to the outlet opening, wherein at least the first metering/conveying device is constructed as a metering/pump device comprising a metering chamber having a variable volume, an inlet connected in fluid terms to the first storage chamber, an inlet valve, an outlet connected in fluid terms to the mixing chamber and an outlet valve, wherein the mixing chamber has a variable volume and the volume can be increased in a passive manner by incoming medium or incoming media and can be reduced by the discharge/conveying device in order to discharge the medium or the media.

2. The metering dispenser as claimed in claim 1, wherein there is provided a discharge head which can be connected to the first storage chamber and the second storage chamber and which comprises at least the outlet opening, the first metering/conveying device which is constructed as a metering/pump device and the discharge/conveying device.

3. The metering dispenser as claimed in claim 2, wherein the discharge head comprises a housing which at least partially delimits the mixing chamber, the metering chamber of the metering/pump device and/or a first supply channel which is provided between the mixing chamber and the metering chamber.

4. The metering dispenser as claimed in claim 3, wherein the housing comprises a base plate and at least one peripheral wall which protrudes from the base plate and which at least partially delimits the mixing chamber or the metering chamber.

5. The metering dispenser as claimed in claim 1, wherein the metering/pump device has a piston which is adjustably supported in the metering chamber and which is adjustably supported in an axial direction of the metering dispenser, wherein the metering/pump device has an actuation handle via which the piston can be adjusted counter to the force of a restoring spring in order to reduce the volume of the metering chamber.

6. The metering dispenser as claimed in claim 5, wherein the inlet and the outlet of the metering/pump device are provided at an end of the metering chamber opposite the piston.

7. The metering dispenser as claimed in claim 1, wherein the inlet valve and the outlet valve are constructed as non-return valves.

8. The metering dispenser as claimed in claim 1, wherein the outlet has a channel piece which protrudes into the metering chamber and the inlet communicates with an annular channel which surrounds the channel piece.

9. The metering dispenser as claimed in claim 1, wherein the metering/pump device comprises a valve element which has the inlet valve and the outlet valve.

10. A metering dispenser for the simultaneous or selective discharge of two fluid, gel-like or paste-like media comprising:

an outlet opening;

a first storage chamber for storing a first medium;

a first metering/conveying device for conveying the first medium from the first storage chamber;

a second storage chamber for storing a second medium;

a second metering/conveying device for conveying the second medium from the second storage chamber;

a mixing chamber which is arranged upstream of the outlet opening, wherein the first medium which is conveyed by the first metering/conveying device and/or the second medium which is conveyed by the second metering/conveying device can be temporarily stored in the mixing chamber; and a discharge/conveying device for conveying the medium or the media from the mixing chamber to the outlet opening, wherein at least the first metering/conveying device is constructed as a metering/pump device comprising a metering chamber having a variable volume, an inlet connected in fluid terms to the first storage chamber, an inlet valve, an outlet connected in fluid terms to the mixing chamber and an outlet valve, wherein the metering/pump device further comprises a valve element which has the inlet valve and the outlet valve, wherein the discharge/conveying device has a piston which can be displaced in the mixing chamber and an outlet channel which is connected in fluid terms to the outlet opening, wherein the discharge/conveying device has an actuation handle by which the piston can be adjusted in order to reduce the volume of the mixing chamber.

11. The metering dispenser as claimed in claim 10, wherein the outlet opening is provided on the actuation handle and the outlet channel extends through the piston.

12. The metering dispenser as claimed in claim 11, wherein a static mixing system for redirecting the flow is provided in the outlet channel.

13. The metering dispenser as claimed in claim 12, wherein the static mixing system has a mandrel which protrudes into the outlet channel, wherein a helical path is provided on a wall of the outlet channel and/or a wall of the mandrel.

14. A discharge head for a metering dispenser having a first storage chamber for storing a first medium and a second storage chamber for storing a second medium, the discharge head comprising:

an outlet opening;

a first metering/pump device for conveying the first medium from the first storage chamber, wherein the first metering/pump device has a metering chamber having a variable volume, an inlet having an inlet valve and an outlet having an outlet valve;

a second metering/pump device for conveying the second medium from the second storage chamber, wherein the second metering/pump device has a metering chamber having a variable volume, an inlet having an inlet valve and an outlet having an outlet valve;

a mixing chamber which is arranged upstream of the outlet opening, wherein the first medium which is conveyed by the first metering/pump device and/or the second medium which is conveyed by the second metering/pump device can be temporarily stored in the mixing chamber; and a discharge/conveying device for conveying the medium or the media from the mixing chamber to the outlet opening, the mixing chamber having a variable volume, wherein the volume can be increased in a passive manner by incoming medium or incoming media and can be reduced by the discharge/conveying device in order to discharge the medium or the media.

15. A discharge head for a metering dispenser having a first storage chamber for storing a first medium and a second storage chamber for storing a second medium, the discharge head comprising:

an outlet opening;

a first metering/pump device for conveying the first medium from the first storage chamber, wherein the first metering/pump device has a metering chamber having a variable volume, an inlet having an inlet valve and an outlet having an outlet valve;

a second metering/pump device for conveying the second medium from the second storage chamber, wherein the second metering/pump device has a metering chamber having a variable volume, an inlet having an inlet valve and an outlet having an outlet valve;

a mixing chamber which is arranged upstream of the outlet opening, wherein the first medium which is conveyed by the first metering/pump device and/or the second medium which is conveyed by the second metering/pump device can be temporarily stored in the mixing chamber; and a discharge/conveying device for conveying the medium or the media from the mixing chamber to the outlet opening, the discharge/conveying device including a piston which can be displaced in the mixing chamber and an outlet channel connected in fluid terms to the outlet opening, and the discharge/conveying device further includes an actuation handle by which the piston can be adjusted in order to reduce the volume of the mixing chamber.

16. The metering dispenser as claimed in claim 10, wherein there is provided a discharge head which can be connected to the first storage chamber and the second storage chamber and which comprises at least the outlet opening, the first metering/conveying device which is constructed as a metering/pump device and the discharge/conveying device.

17. The metering dispenser as claimed in claim 16, wherein the discharge head comprises a housing which at least partially delimits the mixing chamber, the metering chamber of the metering/pump device and/or a first supply channel which is provided between the mixing chamber and the metering chamber.

18. The metering dispenser as claimed in claim 17, wherein the housing comprises a base plate and at least one peripheral wall which protrudes from the base plate and which at least partially delimits the mixing chamber or the metering chamber.

* * * * *